United States Patent [19]

Swilley

[11] Patent Number: 4,712,837

[45] Date of Patent: Dec. 15, 1987

[54] CHAIR WITH INTERLOCKING MULTIPLE COMPONENTS

[76] Inventor: Dennis N. Swilley, #12 W. Oak Bluff, Aubrey, Tex. 76227

[21] Appl. No.: 916,870

[22] Filed: Oct. 9, 1986

[51] Int. Cl.[4] ..... A47C 4/00

[52] U.S. Cl. ..... 297/442; 297/440; 297/443

[58] Field of Search ..... 297/440, 442, 443; 248/174

[56] References Cited

U.S. PATENT DOCUMENTS

| | | | |
|---|---|---|---|
| D. 78,016 | 3/1929 | Goble . | |
| 1,735,851 | 11/1929 | Burton . | |
| 2,456,111 | 12/1948 | Creech | 297/442 X |
| 2,479,086 | 8/1949 | Silverman . | |
| 2,486,987 | 11/1949 | Scarlett . | |
| 2,490,884 | 12/1949 | Rau | 297/443 |
| 2,543,875 | 3/1951 | Silverman | 297/440 X |
| 2,792,877 | 5/1957 | West, Jr. | 297/443 |
| 3,460,866 | 8/1969 | Kessel | 297/442 X |
| 3,485,527 | 12/1969 | Barghout | 297/442 X |
| 3,527,497 | 9/1970 | Self . | |
| 3,547,491 | 12/1970 | Bovasso | 297/440 X |
| 3,788,700 | 1/1974 | Wartes . | |
| 3,950,028 | 4/1976 | Schnepel . | |
| 4,046,421 | 9/1977 | Spound et al. . | |
| 4,188,067 | 2/1980 | Elmer . | |
| 4,225,180 | 9/1980 | Gillis . | |
| 4,234,227 | 11/1980 | Faust . | |
| 4,235,473 | 11/1980 | Aginar . | |
| 4,340,251 | 7/1982 | Geoffroy-Dechaume . | |

OTHER PUBLICATIONS

Nov. 4, 1985 issue of Newsweek, pp. 82–83, article entitled "Furniture Made Fun" by Douglas Davis.

*Primary Examiner*—Kenneth J. Dorner
*Assistant Examiner*—Peter R. Brown
*Attorney, Agent, or Firm*—Merchant, Gould, Smith, Edell, Welter & Schmidt

[57] ABSTRACT

A portable, multiple purpose chair is disclosed that is easily assembled and disassembled for transport, storage and use. The chair components include right and left hand leg members, a seat member, a back member, an arm member having right and left hand arm portions joined by an interconnecting section, and a support member. Each of the components is planar, and is either configured as an equilateral triangle or is based on an equilateral triangle. The components are formed with slots to interlockably connect one component to another.

26 Claims, 13 Drawing Figures

FIG. 3
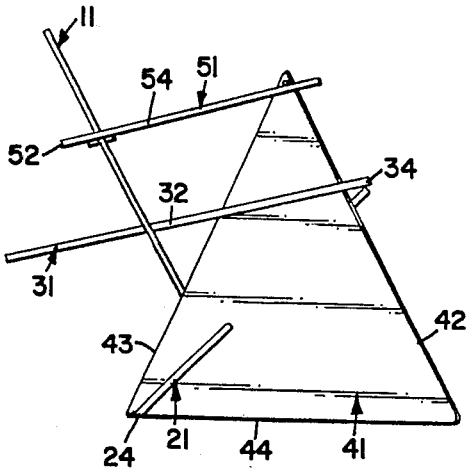
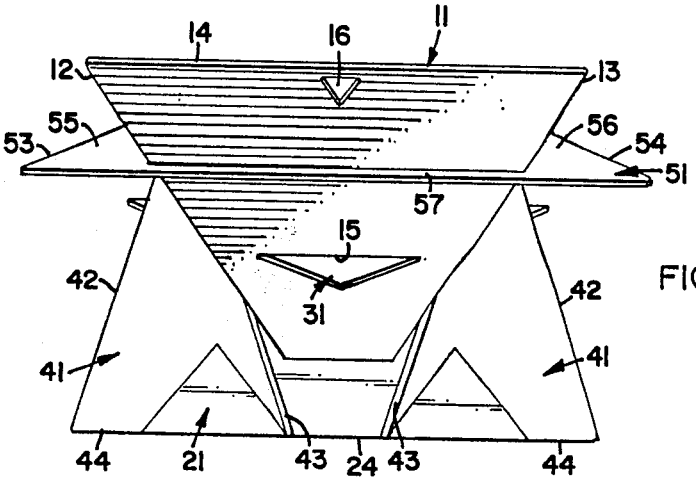
FIG. 4

FIG. 5
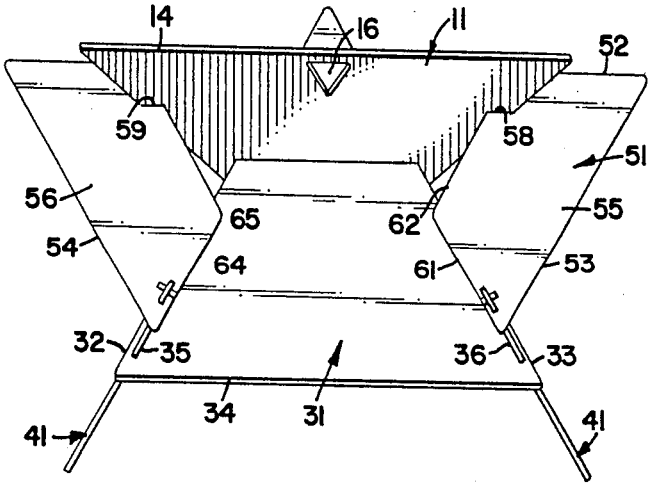
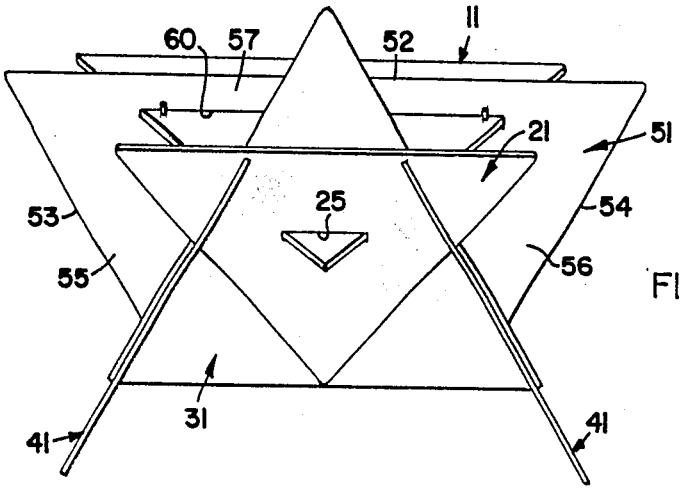
FIG.6

FIG. 7
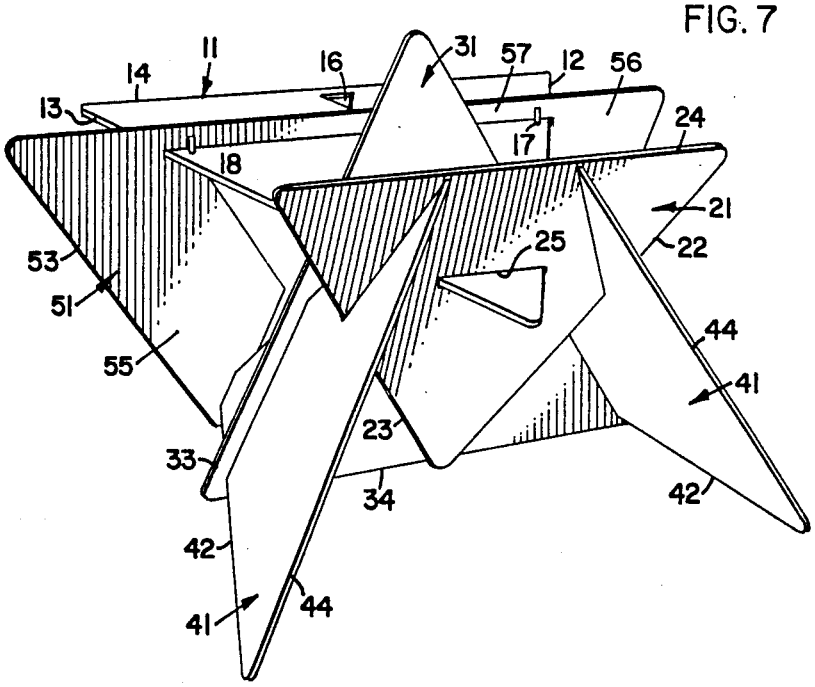
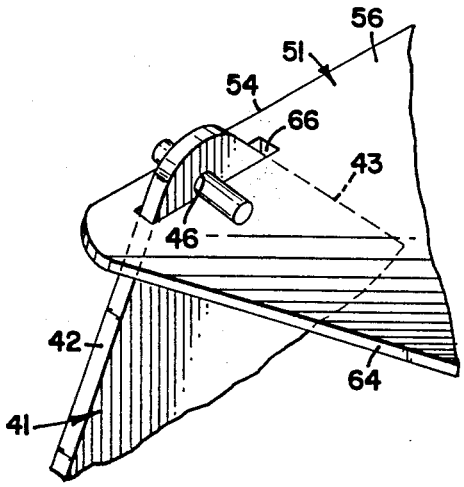
FIG. 8

CHAIR WITH INTERLOCKING MULTIPLE COMPONENTS

The invention is directed to a portable, multiple-purpose chair that can be easily assembled and disassembled for transport, storage and use.

The inventive chair addresses the need for an aesthetically attractive, sturdy, portable chair that can be used outside, such as at the beach or on a deck, and/or inside the home as casual furniture.

Most chairs are designed for either the outside or inside environment, and lack the versatility of both types of use. Generally speaking, a chair intended for an inside environment does not lend itself aesthetically to outside use, and the converse also holds true.

Further, although many chairs intended for outside use are portable, they are typically lightweight and of little structural strength, and they are rarely aesthetically attractive.

The inventive chair represents a unique solution to all of these problems. It comprises a number of components that are preferably planar (e.g., formed from plywood), and which are designed to interlockably assemble into a unit that is extremely rigid and sturdy even though it uses no fasteners or connectors other than a small number of simple dowels.

Because the components are planar, they can be stacked face-to-face for transport or storage, occupying a minimum of space relative to the size of the chair in assembled form.

In the preferred embodiment, each of the components is either configured as an equilateral triangle or is based on an equilateral triangle. As such, it is not only easily assembled and disassembled, but also is aesthetically unique and unusually attractive for both inside and outside environments. In addition, the components are fully reversible, which simplifies assembly and permits various finish combinations if desired.

The several features and advantages of the inventive chair will be more fully appreciated from the acconpanying drawings and specification.

BRIEF DESCRIPTION OF THE DRAWINGS

FIG. 3 is a side elevational view of the chair;

FIG. 4 is a rear elevational view of the chair;

FIG. 5 is a top plan view of the chair;

FIG. 6 is a bottom plan view of the chair;

FIG. 7 is a perspective view of the chair as viewed from the bottom side thereof;

FIG. 8 is an enlarged fragmentary view of the relationship between the arm and side of the chair;

DETAILED DESCRIPTION OF THE PREFERRED EMBODIMENT

Reference is initially made to FIGS. 9–13 showing the individual components of the inventive chair, all of which are based on equilateral triangles. In the preferred embodiment, each of the components is fabricated from ½ inch plywood, the outer veneers of which are hardwood for both beauty and wearability.

Figure 9:
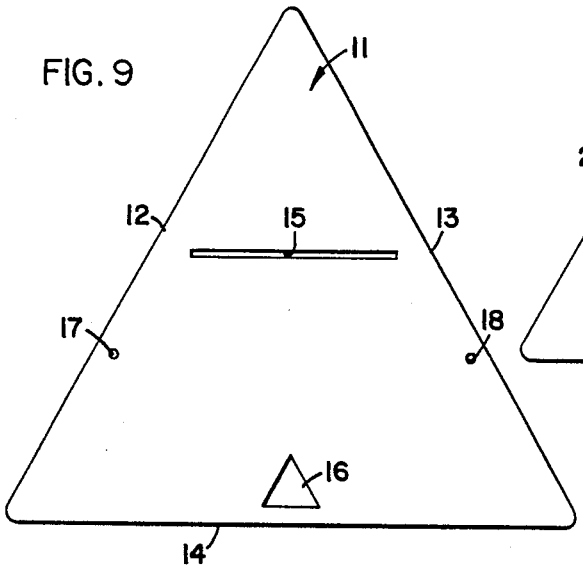
FIG. 9 is a plan view of the back support.

With reference to FIG. 9, a back support for the wing chair is represented generally by the numeral 11. Back support 11 is configured substantially as an equilateral triangle having sides 12, 13 that in the preferred embodiment are 39 inches in length, and a base 14 that is 39¼ inches in length. As shown, the corners of back support 11 are rounded for aesthetic purposes as well as to avoid sharp corners.

A closed slot 15 is formed in the back support 11 to receive the seat as discussed in further detail below. In the preferred embodiment, the slot 15 is ¾ inch in width, has a length of 13¾ inches and is spaced 18½ inches from the base 14.

A triangular opening 16 is centered along the base 14 for aesthetic purposes. In the preferred embodiment, the triangular opening 16 is ¾ inches from the base 14 and has equal sides of 3¼ inches.

The back support is also provided with two dowel holes 17, 18 along the sides 12, 13, respectively. Holes 17, 18 are spaced from the base 14 8 7/16 inches in the preferred embodiment, and 7/8 inches from the associated side. Each is preferably ½ inch in diameter.

Figure 10:
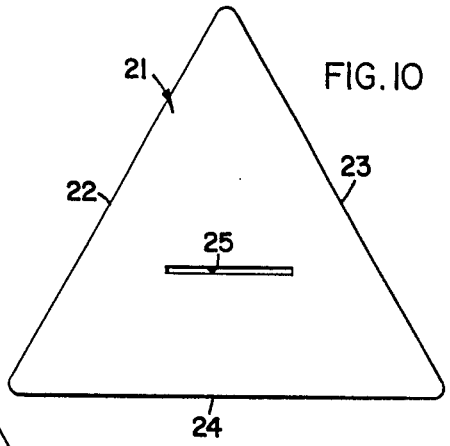
FIG. 10 is a plan view of the rear stabilizer and seat support.

With reference to FIG. 10, a seat support that also functions as a rear stabilizer bears the general reference numeral 21. Seat support 21 is also configured substantially as an equilateral triangle, having sides 22, 23 that are 29 inches in length in the preferred embodiment, and a base 24 that is 29⅝ inches in length. The corners are preferably rounded.

A closed slot 25 is formed in the seat support, the purpose of which is to interlockably receive the back support as discussed in further detail below. In the preferred embodiment, the slot 25 is ⅝ inches in width and has a length of 8½ inches, and is centered between the sides 22, 23 8 inches from the base 24.

Figure 11:
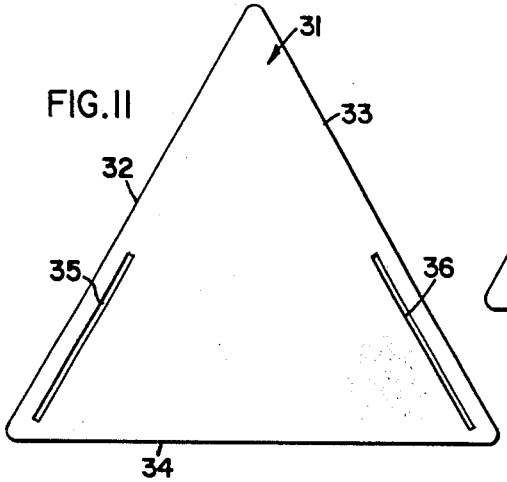
FIG. 11 is a plan view of the seat.

With reference to FIG. 11, a seat member is represented generally by the numeral 31. Seat 31 is also configured as an equilateral triangle, having sides 32, 33 and a base 34 all of which are 33¼ inches in length in the preferred embodiment. The corners of seat 31 are rounded.

Extending part way along and parallel to each of the sides 32, 33 are closed slots 35, 36. In the preferred embodiment, the slots are ⅝ inches in width and have a length of 14 inches. The slots begin approximately ⅞ inch from the base 34 and are spaced from the respective sides 32, 33 one inch.

Figure 12:
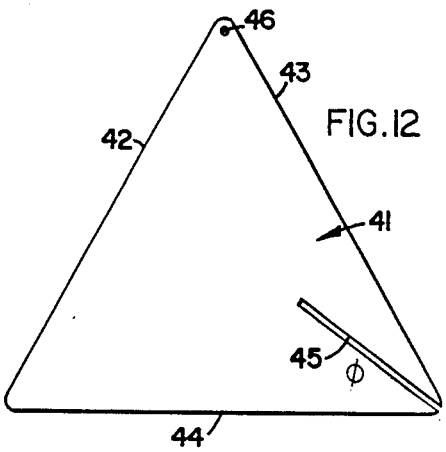
FIG. 12 is a plan view of one of two identical sides.

With reference to FIG. 12, one of two identical legs is represented generally by the numeral 41. Leg 41 is also configured as an equilateral triangle, having sides 42, 43 and a base 44 that are 29¼ inches in length in the preferred embodiment. The corners are rounded in the same manner as the other components.

An open slot 45 begins at the apex of side 43 and base 44, extending toward the middle of leg 41 as shown. The purpose of slot 45 is to interlockably receive the seat support 21, as described in further detail below. Slot 45 subtends an angle $\phi$ which, in the preferred embodiment, is approximately 36°. Also in the preferred embodiment, slot 45 is ⅝ inches in width and has a length of 11 inches.

A dowel hole 46 is formed at the apex of sides 42 and 43. In the preferred embodiment, dowel hole 46 has a ½ inch diameter and is spaced ⅝ of an inch from each of the sides 42, 43.

For each of the substantially equilateral members 11, 21, 31 and 41, the convergence of the two sides forms a corner referred to as an upper apex, and each of the two sides and base converge to form a corner referred to as a base apex.

Figure 13:
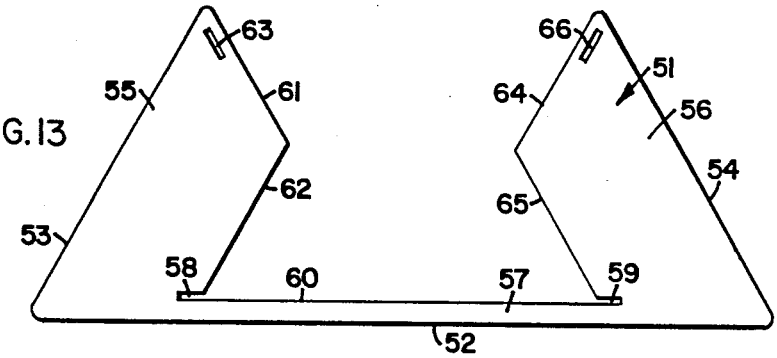
FIG. 13 is a plan view of the arm rest.

With reference to FIG. 13, an irregularly shaped arm rest bears the general reference numeral 51. Consistent with the other components, arm rest 51 is based on an equilateral triangle, although several portions are cut away to accomplish its intended function. Arm rest 51 includes a base 52 with shorter sides 53, 54 that respectively subtend a 60° angle with base 52. In the preferred embodiment, base 52 is 52 inches in length, and the sides 53, 54 are 24¾ inches in length.

Portions are cut away to leave arm rests 55, 56 joined by a thin interconnecting section 57. This section is defined by the base 52 and an opposed, parallel edge bearing the reference numeral 60. Short open slots 58, 59 extend along the edge 60 into the arm rests 55, 56, respectively, for a purpose described below.

The arm section 55 is defined by the side edge 53, a shorter side edge 61 that subtends an angle with the side edge 53 that is preferably 60° in the preferred embodiment, (to give the appearance of an equilateral triangle), and a third side 62 that is parallel with the side edge 53. A short closed slot 63 is formed in the arm section 55 near the apex of the side edges 53, 61 and extending parallel to the side edge 61.

Arm section 56 has corresponding side edges 64, 65 and a short closed slot 66, as well as the side edge 54.

In the preferred embodiment, the base edge 52 is 52 inches in length and the side edges 53, 54 are 24¾ inches in length. The width of arm rests 55, 56 (e.g., the dimension between edges 53 and 62) is 10⅜ inches, and the width of thin section 57 is 1½ inches. The slots 58, 59 are ⅝ inch in width and extend 2⅝ inches from the side edges 62, 65 respectively. The length of edge 60, including the slots 58, 59, is 32⅞ inches. The slots 63, 66 are ½ inch in width, 3 inches in length, spaced ½ inch from the edges 61, 64, respectively, and begin approximately one inch from the sides 53, 54.

The dimensions given for the several components are exemplary only, and specifically pertain to the preferred embodiment as a full size chair. Other dimensions may be used within the scope of the invention, including a smaller scale for children.

The assembly of components 11, 21, 31, 41 and 51 is shown in FIGS. 1–7.

In assembling the chair, the legs 41 are first oriented relative to the seat support 21, causing the slot 45 of one of the legs 41 to slide over the side 23 of seat support 21, and causing the slot 45 of the other leg 41 to slide over the side 22 of seat support 21. This assembly appears most clearly in FIG. 2, which also shows the legs 41 to diverge at approximately 60° relative to each other.

Figure 1:
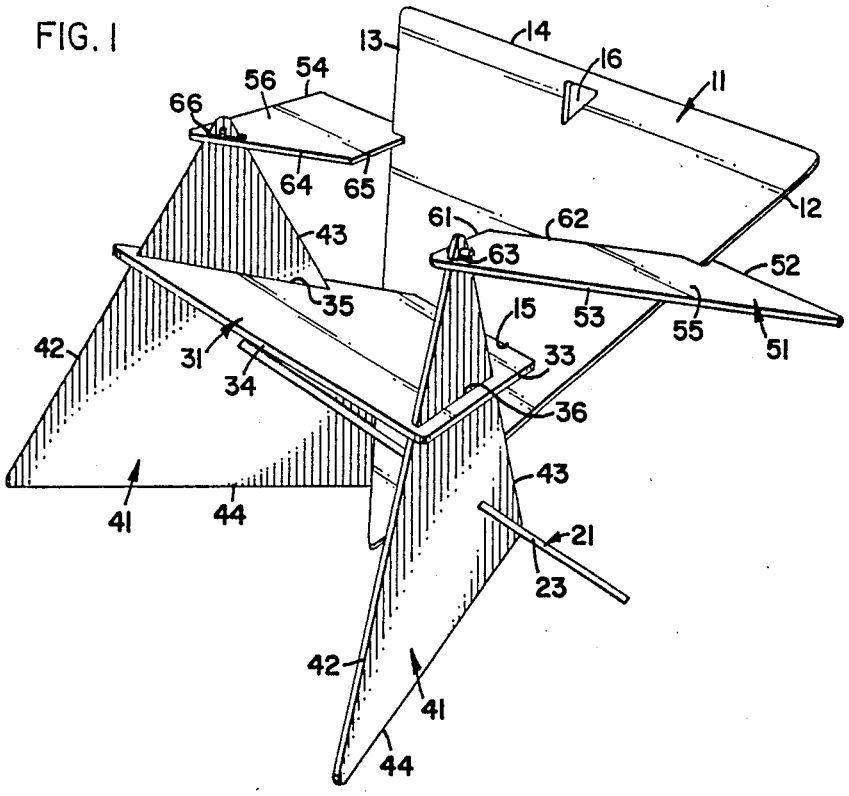
FIG. 1 is a perspective view of the inventive chair as viewed from the front and side thereof.

The seat 31 is now oriented relative to the back support 11 so that the apex between sides 32, 33 of seat 31 is inserted into the slot 15 of back support 11. It should be noted that the back support 11 as shown in FIG. 1 is inverted from the position shown in FIG. 9.

At this point, seat 31 is oriented so that the apexes of the legs 41 are inserted into the respective slots 35, 36 until each of the slots acts as a limit to further movement. This best appears in FIG. 1, in which the seat 31 is also shown to slope downward slightly.

Figure 2:
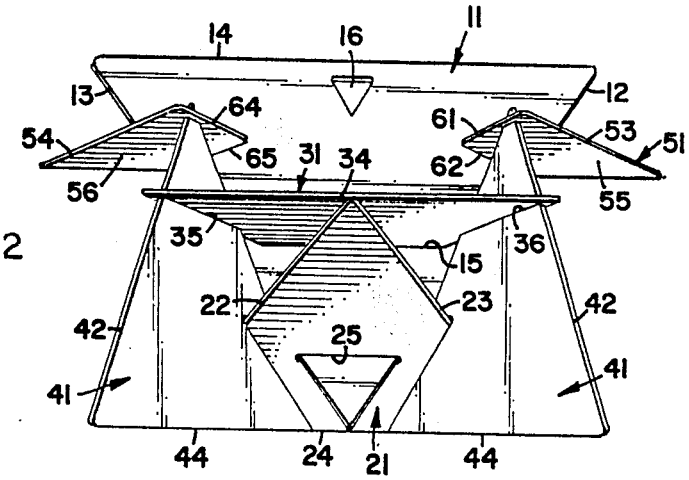
FIG. 2 is a front elevational view of the chair.

At the time the seat 31 slides over the top of the legs 41, the lower apex of back support 11 (between sides 12, 13) is also inserted into the slot 25 of seat support 21, which is best shown in FIG. 2.

At this time, the arm rest 51 is oriented relative to the back support 11 with the interconnecting portion 57 behind the back support 11, but with the arms 55, 56 projecting forward. By lowering the interconnecting portion 57 of the arm rest 51, the sides 12, 13 of back support 11 are caused to enter the slots 58, 59 of arm rest 51, and the interconnecting portion 57 is then lifted until the arms 55, 56 are disposed above the dowel holes 17, 18 of back support 11. At this point, dowels are inserted into the dowel holes 17, 18, locking the arm rest 51 in place.

Simultaneously with this movement, the arms 55, 56 are oriented relative to the legs 41 so that the upper apexes defined by sides 42, 43 of the legs 41 project into the shorter slots 63, 66. As best shown in FIG. 8, a dowel is then inserted into each of the dowel holes 46, locking the associated arm 55, 56 in place.

As assembled, the chair is extremely strong and rigid, notwithstanding manufacture of the components from ½ inch plywood, the absence of conventional fasteners and the fact that it is capable of being disassembled for storage and transport.

The strength and rigidity of the chair are the result of the configuration of the components as well as their dimensions. First, and with reference to FIGS. 1–3, the lower side edge 44 of each of the sides 41 presents a straight, stable surface upon which the chair rests. The legs 41 are in turn supported by the seat support 21, the lower side edge 24 of which also presents a straight, stable surface to support the chair.

With reference to FIG. 2, the upper apex of back support 11, when inverted, projects through the slot 25 of seat support 21. In the preferred embodiment, the dimensions are chosen so that this apex does not engage the underlying chair support surface. However, it is possible to dimension the apex and/or associated slot so that it will engage and rest on the supporting surface to serve as a load bearing point.

With reference to FIGS. 1–3 and 7, the seat support 21 has a length and projects at an angle so that its upper apex just engages the underside of the seat 31 at a central point along its leading edge (side edge 34). This establishes a centered undersupport for the seat, enabling it to withstand greater stress when in use.

The back support 11 is held in a rigid, firm position at a lower point by virtue of the projection of its upper apex (inverted) through the slot 25 of seat support 21, and at an upper point because it rests in its entirety on the interconnecting section 57 of arm rest 51 within the slots 57, 58. The arm rest 51 is in turn held in place by the dowels inserted into the dowel holes 17, 18, and by the interlocking projection of the upper apexes of legs 41 through the slots 63, 66 of each of the arms 55, 56, and the insertion of retention dowels into the dowel holes 46.

In addition to the strength and rigidity of the assembled components, the chair is also extremely comfortable. The seat 31 itself slopes at an angle of approximately 15° from horizontal, and the back support 11 slopes approximately 30° from vertical. The arms 55, 56 are quite wide, providing the user with ample space to rest his or her arms, as well as for reading material, beverages and the like. If desired, beverage openings may be formed in either or both of the arms 55, 56 to hold cans or bottles without slipping from the arm surface.

The fact that the several components are planar and symmetrical permits each of them to be used reversibly. This greatly simplifies assembly, and also permits different surface finishes to be used on opposite sides to give the chair differing appearances if desired.

The inventive chair can be disassembled simply by reversing the procedure outlined above. Because the components are flat and comparable in size, they may be arranged in a stacked relation and either carried in a portable manner, or stored either in a flat or upright position. In the unassembled, stacked position, the inventive chair occupies relatively little space compared with its overall size in assembled relation.

What is claimed is:

1. A chair capable of being assembled for use and disassembled for portability and storage, comprising:

first and second leg members;

a seat member interlockably connected to and between the leg members;

a back member removably and interlockably connected to the seat member;

an arm member comprising right and left-hand arm portions joined by an interconnecting section, the interconnecting section being removable and interlockably connected to the back member, and the right and left-hand arm portions being removably and interlockably connected to the first and second leg members, respectively;

and a seat support member disposed beneath the seat member, the seat support member being removably and interlockably connected to and between the leg members, and removably and interlockably connected to the back member, and the seat support member having a portion that engageably supports the underside of the seat member.

2. The chair defined by claim 1, wherein each of said members is planar in configuration.

3. The chair defined by claim 2, wherein the seat member comprises first and second enclosed slot means for receiving a portion of the first and second leg members, respectively.

4. The chair defined by claim 2, wherein each leg member comprises open slot means for interlockably receiving the support member.

5. The chair defined by claim 2, wherein the back member comprises slot means for interlockably receiving the seat member.

6. The chair defined by claim 2, wherein the support member comprises slot means for interlockably receiving the back member.

7. The chair defined by claim 2, wherein each of the arm portions comprises slot means to interlockably receive the first and second leg members, respectively.

8. The chair defined by claim 2, wherein each of said members is formed from plywood.

9. The apparatus defined by claim 2, wherein each of said members is triangular at least in part.

10. The chair defined by claim 9, wherein the leg, seat, back and support members substantially comprise equilateral triangles.

11. The chair defined by claim 2, wherein each of said members is substantially symmetrical, whereby each member may be interlockably connected to the associated members in forward or reverse positions.

12. A chair capable of being assembled for use and disassembled for portability and storage, comprising:

first and second planar leg members of triangular configuration, each having a base and two sides with two base apexes and an upper apex, each leg member having an open slot of predetermined width extending from one of its base apexes a predetermined length generally toward the center of the leg member;

a planar seat member of triangular configuration having a base and two sides with two base apexes and an upper apex, the seat member having two enclosed slots of predetermined width respectively extending from a point proximate the base apexes and extending partway along the adjacent side, each slot being sized and disposed to receive the upper apex of one of the leg members;

a planar back member of triangular configuration having a base and two sides with two base apexes and an upper apex, the back member having an enclosed slot parallel to the base and disposed between the base and upper apex to receive the upper apex of the seat member;

a planar support member of triangular configuration with a base and two sides with two base apexes and an upper apex, the support member having an enclosed slot parallel to the base and disposed between the base and upper apex to receive the upper apex of the back member;

the open slot of each leg member sized and disposed to receive the support member in assembled relation;

and an arm member comprising right and lefthand arm rests joined by an interconnecting section, each arm rest having an enclosed slot of predetermined width and with a length less than the enclosed slots of the seat member, said slots being sized and disposed to receive the upper apex of one of the leg members, the interconnecting portions and arm members being sized and related to receive the back member therebetween in assembled relation.

13. The chair defined by claim 12, wherein the arm member further comprises first and second slots extending along the interconnecting section into the right and left-hand arm rests, respectively, said slots being sized and disposed to respectively receive the first and second sides of the back member.

14. The chair defined by claim 12, wherein each leg member further comprises a hole disposed in the upper apex thereof to receive a dowel or the like to restrain movement of the arm rests.

15. The chair defined by claim 12, wherein the back member further comprises first and second holes formed adjacent the first and second sides thereof, the holes being disposed to receive a dowel or the like to restrain movement of the interconnecting portion of the arm member.

16. The chair defined by claim 12, wherein the legs are disposed in a diverging relation in the assembled position.

17. The chair defined by claim 12, wherein the seat member slopes downward from its base to its upper apex in assembled position.

18. The chair defined by claim 12, wherein the base of the back member is disposed above the upper apex, and the back member inclines rearwardly from the upper apex to the base in the assembled position.

19. The chair defined by claim 12, wherein the base of the support member rests on a support surface in the assembled position.

20. The chair defined by claim 19, wherein the upper apex of the support member engagably underlies the seat member in the assembled position.

21. The chair defined by claim 12, wherein the arm rests slope downward toward the interconnecting section in the assembled position.

22. The chair defined, by claim 12, wherein each of said members is formed from plywood.

23. The chair defined by claim 12, wherein the leg, seat, back and support members substantially comprise equilateral triangles.

24. The chair defined by claim 11, wherein each of said members is substantially symmetrical, whereby each member may be interlockably connected to the associated member in forward or reverse positions.

25. A chair, comprising:

first and second leg members, a seat member and a support member, each of which is substantially triangular in configuration, and an arm member;

the seat member being connected to and between the leg members with an apex of the triangular seat member pointing rearwardly of the chair and apexes of the respective leg members pointing generally upward;

the back member being connected to the seat member and having an apex pointing generally downward;

the arm member comprising right and left-hand arm portions joined by an interconnecting section, the interconnecting section supportably engaging the back section and the right and left-hand arm portions being connected to the first and second leg members, respectively;

and, the support member being connected to and between the leg members, and connected to the back member, the support member having an apex that points generally upward toward and in supportive engagement with the underside of the seat member.

26. A chair, comprising:

first and second leg members, a seat member, a back member, an arm member comprising right and left-hand portions jointed by an interconnecting section, and a support member;

the seat member being connected to and between the leg members;

the back member being connected to the seat member;

the interconnecting section of the arm member supportively engaging the back member, and the right and left-hand portion being connected to the first and second leg members, respectively;

and, the support member being disposed beneath the seat member and connected to and between the leg members, the support member further being connected to the back member and including a portion that engageably supports the underside of the seat member.

* * * * *

UNITED STATES PATENT AND TRADEMARK OFFICE

CERTIFICATE OF CORRECTION

PATENT NO. : 4,712,837

DATED : December 15, 1987

INVENTOR(S) : Dennis N. Swilley

It is certified that error appears in the above-identified patent and that said Letters Patent is hereby corrected as shown below:

Column 1, lines 41-42, the word "acconpanying" should be --accompanying--.

Column 1, line 53, after the word "bottom" insert the word --and--.

Column 5, line 24, the word "removable" should be --removably--.

Signed and Sealed this

Thirty-first Day of May, 1988

*Attest:*

*Attesting Officer*

DONALD J. QUIGG

*Commissioner of Patents and Trademarks*